US005125341A

United States Patent [19]

Yaeso

[11] Patent Number: 5,125,341

[45] Date of Patent: Jun. 30, 1992

[54] INK UNIT FOR PRINTING PRESS AND METHOD

[75] Inventor: Felix R. Yaeso, Green Bay, Wis.

[73] Assignee: Paper Converting Machine Company, Green Bay, Wis.

[21] Appl. No.: 700,615

[22] Filed: May 15, 1991

[51] Int. Cl.[5] ..... B41F 31/02

[52] U.S. Cl. ..... 101/367; 101/169; 101/366; 101/350; 101/363

[58] Field of Search ..... 101/367, 364, 350, 366, 101/363, 157, 169; 118/259, 261; 384/131, 141, 147, 148, 151, 132; 227/135

[56] References Cited

U.S. PATENT DOCUMENTS

| | | | |
|---|---|---|---|
| 2,501,944 | 3/1950 | Jaeger et al. | 277/135 |
| 2,795,195 | 6/1957 | Amblard et al. | 277/135 |
| 3,510,177 | 5/1970 | Shimula | 384/147 |
| 4,130,324 | 12/1978 | Becker | 384/147 |
| 4,414,900 | 11/1983 | Kraus et al. | 101/363 |
| 4,581,995 | 4/1986 | Stone | 101/366 |
| 4,590,855 | 5/1986 | Schommer et al. | 101/350 |
| 4,667,595 | 5/1987 | Geretzki | 101/366 |
| 4,796,528 | 1/1989 | Sarazen | 101/208 |
| 4,821,672 | 4/1991 | Bruno | 101/169 |
| 4,879,949 | 11/1989 | Vennike | 101/157 |
| 4,964,336 | 10/1990 | Bock et al. | 101/157 |
| 4,982,660 | 1/1991 | Hamm et al. | 101/350 |
| 5,012,736 | 5/1991 | Van Kanegan et al. | 101/211 |
| 5,027,513 | 7/1991 | Allison, Jr. | 101/169 |

FOREIGN PATENT DOCUMENTS

| | | | |
|---|---|---|---|
| 2827901 | 6/1978 | Fed. Rep. of Germany | 101/169 |
| 0589259 | 6/1947 | United Kingdom | 384/151 |
| 0612178 | 11/1948 | United Kingdom | 101/157 |

OTHER PUBLICATIONS

Richard E. Smith, "Seal Arrangement", Xerox Disclosure Journal vol. 1, No. 6, Jun. 1976, pp. 49, 50.

*Primary Examiner*—Edgar S. Burr
*Assistant Examiner*—Anthony Nguyen
*Attorney, Agent, or Firm*—Tilton, Fallon, Lungmus & Chestnut

[57] ABSTRACT

An ink unit for a printing press having a relatively elongated cylindrical roll and a relatively elongated ink fountain, the ink fountain being equipped with upper and lower doctor blades and with end seal members arranged at an angle of from about 25° to about 65°.

3 Claims, 1 Drawing Sheet

Fig. 1
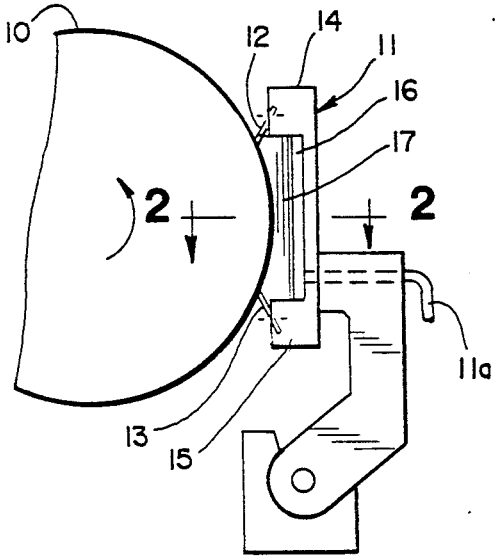
Fig. 3
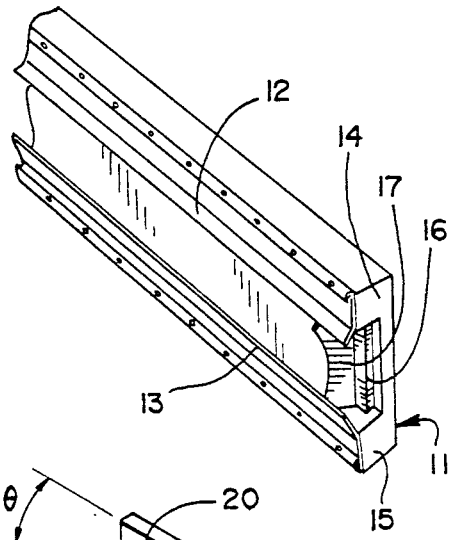
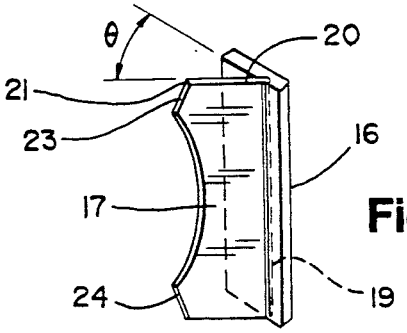
Fig. 4
Fig. 2
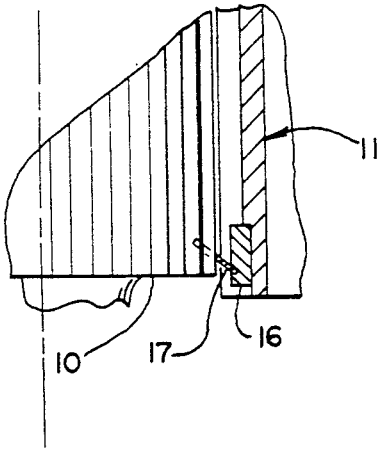
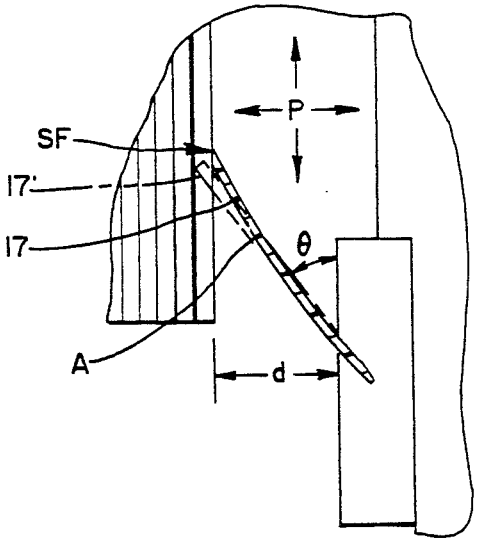
Fig. 5

INK UNIT FOR PRINTING PRESS AND METHOD

BACKGROUND AND SUMMARY OF INVENTION

This invention relates to an ink unit for a printing press and method and, more particularly, to a novel arrangement of end seals on the ink fountain associated with a cylindrical transfer roll, i.e., the anilox roll.

In the past, a common practice has been to run the end dams on ink chambers with a small, fixed gap from the anilox roll surface. In this way, the majority of ink would return to the reservoir via the return line and a minor amount would pass through the end dams and return through a catch pan. This provided adequate printing performance but proved "messy", i.e., the uncontained ink must be cleaned off of several surfaces after the printing job is finished.

Representative of the attempts to solve this problem are U.S. Pat. Nos. 4,581,995 and 4,590,855. However, these involve relatively complex mechanisms which substitute cost and other problems for the basic problem.

The main technical problem to be overcome in an end seal is to provide adequate sealing force to overcome the ink chamber static pressure without interfering with the doctor blade loading. The doctor blade loading must be consistent across the anilox roll, right up to the end seal, so that the full roll width may be used for printing. Compounding the problem is doctor blade wear which must allow the doctor blade holder to move closer to the anilox roll to maintain the same doctor blade loading throughout the life of the blade.

According to the invention, a flexible member, shaped to the anilox roll curvature is supported in the ends of the doctor blade holder. The material is advantageously the same as the doctor blade material, preferably plastic, to provide good wear characteristics.

The end seal member is mounted at an angle so that, like the doctor blades, it can flex when the doctor blade assembly is forced against the roll. The angle is chosen so that the resulting stiffening (increase in force for increase in deflection) is roughly the same as the doctor blade stiffness. The angle is further chosen to tip the seal inward so that a component of the static pressure from the ink supply will add to the seal loading, i.e., higher pressures cause higher seal forces.

A number of benefits accrue from the practice of the invention including:

1. No anilox roll modifications needed—the seal rides directly on the engraved or unengraved roll surface;
2. Simple in construction and installation—no adjustments are required;
3. Allows for doctor blade wear—the seal does not interfere with doctor blade loading;
4 The seal can be adapted to a wide range of ink chamber designs;
5. The seal increases sealing force with increase in ink chamber static pressure; and
6. The seal is available at low cost and maintenance.

Other objects and advantages of the invention may be seen in the details in the ensuing specification.

BRIEF DESCRIPTION OF DRAWING

The invention is described in conjunction with the accompanying drawing, in which FIG. 1 is a fragmentary side elevational view of an anilox roll equipped with a fountain featuring the invention;

FIG. 2 is a fragmentary enlarged sectional view such as would be seen along the sight line 2—2 as applied to FIG. 1;

FIG. 3 is a fragmentary perspective view of the ink fountain showing the doctor blades and one end seal;

FIG. 4 is an enlarged perspective view of one end seal constructed according to the teachings of the invention; and FIG. 5 is a view similar to FIG. 2 and equipped with reference symbols to explain a typical example.

DETAILED DESCRIPTION

In the illustration given and with reference to FIG. 1, the numeral 10 designates an anilox roll which normally has a pattern of cells of variable depth. The numeral 11 designates generally the ink fountain which contains the ink. The fountain 11 is equipped with upper and lower doctor blades 12 and 13. In the illustration given with the rotation of the anilox roll 10 being counterclockwise as designated, the upper doctor blade is the scraping or "cleaning" doctor—limiting the amount of ink to be picked up by the cells. Thus, this is a "reverse angle" doctor blade. The lower doctor blade 13 is a trailing or "wiping" doctor blade to limit the out flow of ink in an undesired direction and is mounted at a "positive angle". When the anilox roll rotation is reversed, the functions of the blades are reversed. Generally illustrative of this arrangement is co-owned U.S. Pat. No. 5,012,734 and express reference is made thereto for the purpose of ascertaining details of construction and operation not specifically set forth herein. For example, the ink delivery is represented schematically as at 11*a* and the return omitted for simplicity of illustration.

It will be noted that the fountain 11 is generally C-shaped to provide upper and lower branches 14, 15 supporting the doctor blades 12, 13. Interposed between the branches 14, 15 (see also FIG. 3) is a holder 16 for the end dam or seal 17. It will be appreciated that a mirror-image holder and dam is provided at the other end of the fountain 11 which also constitutes the doctor blade holder.

According to the invention, the end dam 17 is arranged at an angle to the axis of the anilox roll 10—as can be readily appreciated from a consideration of FIG. 2. Thus, all of the seals provided by the blades 12, 13 and dams 17 are developed by free flexing edges.

As mentioned previously, the end dam 17 is constructed of the same material as the plastic doctor blades 12, 13. This provides for flexing so that upon pivotal mounting of the fountain 11 about the pivot 18 on the frame the end dams can flex so as to conform to the surface of the anilox roll in the same fashion as the doctor blades. Additionally and equally importantly, the arrangement of the end dams at an angle $\theta$ preferably from about 25° to about 65° brings about an added sealing force because of the static pressure of the ink in the chamber defined by the fountain 11. Excellent results are obtained in commercial printing installations as set forth in the following example.

EXAMPLE

Referring to FIG. 5, the seal A is of the order of about $\frac{3}{4}$ to 4 square inches. By seal area, reference is made to that area of the end seal between the holder 16 and the anilox roll 10. Still further, in the commercial example distance d between the anilox roll 10 and the holder 16 is of the order of about ⅜" to about 2".

A typical end seal is made from 0.050" thick plastic and deflected about 0.010" to 0.100" by the anilox roll. This deflection will produce a seal force of about 0.1 pound to 2 pounds.

To determine the seal force due to ink static pressure in this example, the angle of mounting ($\theta$ in FIGS. 4 and 5) is 45° and the static pressure P is about 2" of water. Further, the seal area A is about 1.5 square inches and the distance d between the anilox roll and holder is about 1". In such a case, the increase in seal force SF due to static pressure is determined by the following equation:

$$SF = \frac{dPA(.0361)}{Z \cos \theta} = 0.76 \text{ lb.}$$

The combination of deflection force and pressure force insures a successful seal and without the need for a flexible mounting. Previous attempts at flexible mounts have resulted, as indicated above, in the production of more problems than they solve.

Referring now to FIG. 4, it will be seen that the end seal 17 is generally rectangular in shape having generally straight ends and one longer side as at 19 which is received within an angled slot 20 within the holder 16. The free-flexing other longer side 21 is centrally recessed as at 22 to provide an elliptical segment conforming to the periphery of the anilox roll with beveled end portions as at 23 and 24 to conform to the generally planar doctor blades—see the upper portion of FIG. 1. The holder 16 is equipped with bolt holes for securing the holder to the fountain 11 between the branches 15, 16 and the fountain 11 is equipped with similar aligned openings.

Excellent results are obtained where the angle $\theta$ is of the order of about 45° to maximize incremental seal force while providing maximum ability to flex to the anilox roll surface.

According to this example, the end seals 17 and doctor blades 12, 13 are constructed of 0.050" thick ultra high molecular weight (UHMW) polyethylene or similar plastic material. This results in an advantageous stiffness/resilience so as to permit the flexing of the end dam from the dashed line position 17' to the solid line position designated 17 as illustrated in FIG. 5. The flexing, of course, is increased by the component of the static pressure derived from the ink pool within the fountain 11. Suitable blade and end dam material can be obtained from Flexo Concepts, Inc. located at Norwell, Mass., denoted "plastic doctor blades".

Another advantageous feature of the invention is the seal effected by the end dams 17 between the doctor blades 12, 13. Even as the doctor blades wear and therefore have to be moved relative to the anilox roll, the end dams accommodate this movement without affecting the seal and because of their flexible nature, can accommodate to movement of the doctor blades. Normally, the doctor blades are moved either to a predetermined position or a predetermined pressure. In either case, the beveling of the ends of the end seals accommodate this relocation to compensate for wear without destroying the integrity of the sealed ink chamber.

While in the foregoing specification a detailed description of an embodiment of the invention has been set down for the purpose of illustration, many variations in the details hereingiven may be made by those skilled in the art without departing from the spirit and scope of the invention.

I claim:

1. An ink fountain unit for a printing press comprising a frame, a relatively elongated cylindrical transfer roll rotatably mounted in said frame, a relatively elongated ink fountain mounted on said frame adjacent said roll and parallel thereto, said fountain being equipped with ink delivery means so as to maintain an ink level therein, said fountain being equipped with top, bottom and end seals having free edges bearing against said roll to define a closed chamber for ink, said top and bottom seals being generally planar doctor blades constructed of relatively resilient material, each of said end seals being generally planar and also being constructed of a relatively resilient material so as to continuously flex against said roll, each of said end seals being inclined at an angle of from about 25° to about 65° to the axis of said roll, said end seals being divergent in proceeding away from the free edges thereof, each end seal being generally rectangular in side elevation to provide a pair of generally straight horizontal ends, a straight vertical mounting side and a free flexing vertical side opposite said mounting side, said free flexing side having an elliptical segmental contour intermediate the ends thereof to conform to the surface of an ink transfer roll, said free flexing side immediately adjacent the ends thereof being beveled to conform to and engage the planar surfaces of said top and bottom seals.

2. The ink fountain unit of claim 1 in which said fountain is generally C-shaped in transaxial planes to provide a pair of branches for supporting said top and bottom seals, plate means mounted between said top and bottom seal, plate means mounted between said branches and equipped with angled mounting means, said end seals being supported in said angled mounting means.

3. The ink fountain unit of claim 1 in which said angle is about 45° .

* * * * *